US005989792A

United States Patent [19]

Miyai

[11] Patent Number: 5,989,792

[45] Date of Patent: Nov. 23, 1999

[54] PHOTOGRAPHIC FILM

[75] Inventor: Junichi Miyai, Wakayama-ken, Japan

[73] Assignee: Noritsu Koki Co., Ltd., Wakayama, Japan

[21] Appl. No.: 08/997,818

[22] Filed: Dec. 24, 1997

[30] Foreign Application Priority Data

Dec. 25, 1996 [JP] Japan ..... 8-344864

[51] Int. Cl.[6] ..... G03C 3/02; G03C 1/765

[52] U.S. Cl. ..... 430/501; 430/496; 242/551; 242/553; 242/556; 242/556.1

[58] Field of Search ..... 242/551, 553, 242/556, 556.1; 430/496, 501

[56] References Cited

U.S. PATENT DOCUMENTS 3,573,047 3/1971 Jeffee ..... 430/496

5,475,463 12/1995 Yamaguchi et al. ..... 354/321

5,652,941 7/1997 Arimoto et al. ..... 354/319

*Primary Examiner*—Mark F. Huff

*Attorney, Agent, or Firm*—Smith Patent Office

[57] ABSTRACT

A photographic film is connected with a leader by engagement with an engaging piece provided on the leader. The film is then conveyed by being pulled by the leader since engaging holes in the film are engageable with engaging pieces provided on a leader. The engaging holes are formed at a leading end portion of a photographic film. Portions of the photographic film around the engaging holes are reinforced by adhering a reinforcement piece to the leading end portion of the photographic film, thereby preventing the photographic film from being torn at the engaging holes.

7 Claims, 4 Drawing Sheets

PHOTOGRAPHIC FILM

BACKGROUND OF THE INVENTION

1. Field of the Invention

The present invention relates to an undeveloped photographic film which is to be developed by a film developing apparatus of a leader-convey type.

2. Discussion of the Related Art

Generally, when a photographic film is developed by an automatic film developing apparatus of the leader-convey type, the undeveloped photographic film is connected with a flexible leader and is conveyed after the leader along a film conveyance path of a developing device.

The leader and the photographic film are generally connected by adhering a splice tape thereto. However, this requires a splice gauge in order to connect the photographic film in a specified position of the leader. Further, when the photographic film is separated by cutting after development, the splice tape remains on the leader making it necessary to peel the splice tape back from the leader so that the leader can be reused. Thus, this type of connection is very cumbersome.

Further, this connection is not economical because the splice tape cannot be reused.

In order to solve such a problem, a film connecting construction of a film-hook type in which an engaging piece is provided on a leader and an engaging hole is formed at the leading end of a photographic film has been proposed. In this construction the engaging piece is engaged with the engaging hole.

In the automatic film developing apparatus of a leader-convey type, the film is pulled by the leader that is conveyed before it. Accordingly, a resistance produced during the movement of the film acts on the connecting portion with the leader. In the film connecting construction of a film-hook type, a pulling force acts on the engaging hole formed at the leading end of the film. Accordingly, if the film is caught during the conveyance, the film may be torn at the engaging hole. Particularly, since a 135 film taken up into a cartridge is thinner than an APS film, it is likely to be torn if the film catches in the processing.

SUMMARY OF THE INVENTION

An object of the present invention is to enhance the connection strength of a film with a leader in the development of the film using a leader of the film-hook type.

In order to solve the above mentioned problems, the invention is directed to a photographic film formed at a leading end portion thereof with at least one engaging hole which is engageable with a corresponding engaging piece provided on a leader for pulling the photographic film. The leading end portion of the film is reinforced by adhering a reinforcement piece thereto and the reinforcement piece is formed with a corresponding hole cut in a position facing the engaging hole.

BRIEF DESCRIPTION OF THE DRAWINGS

The above and other objects and features of the present invention will be clearly understood from the following description with respect to a preferred embodiment thereof when considered in conjunction with the accompanying drawings, wherein the same reference numerals have been used to denote the same or similar parts or elements, and in which.

DETAILED DESCRIPTION OF THE PREFERRED EMBODIMENTS

Figure 1:
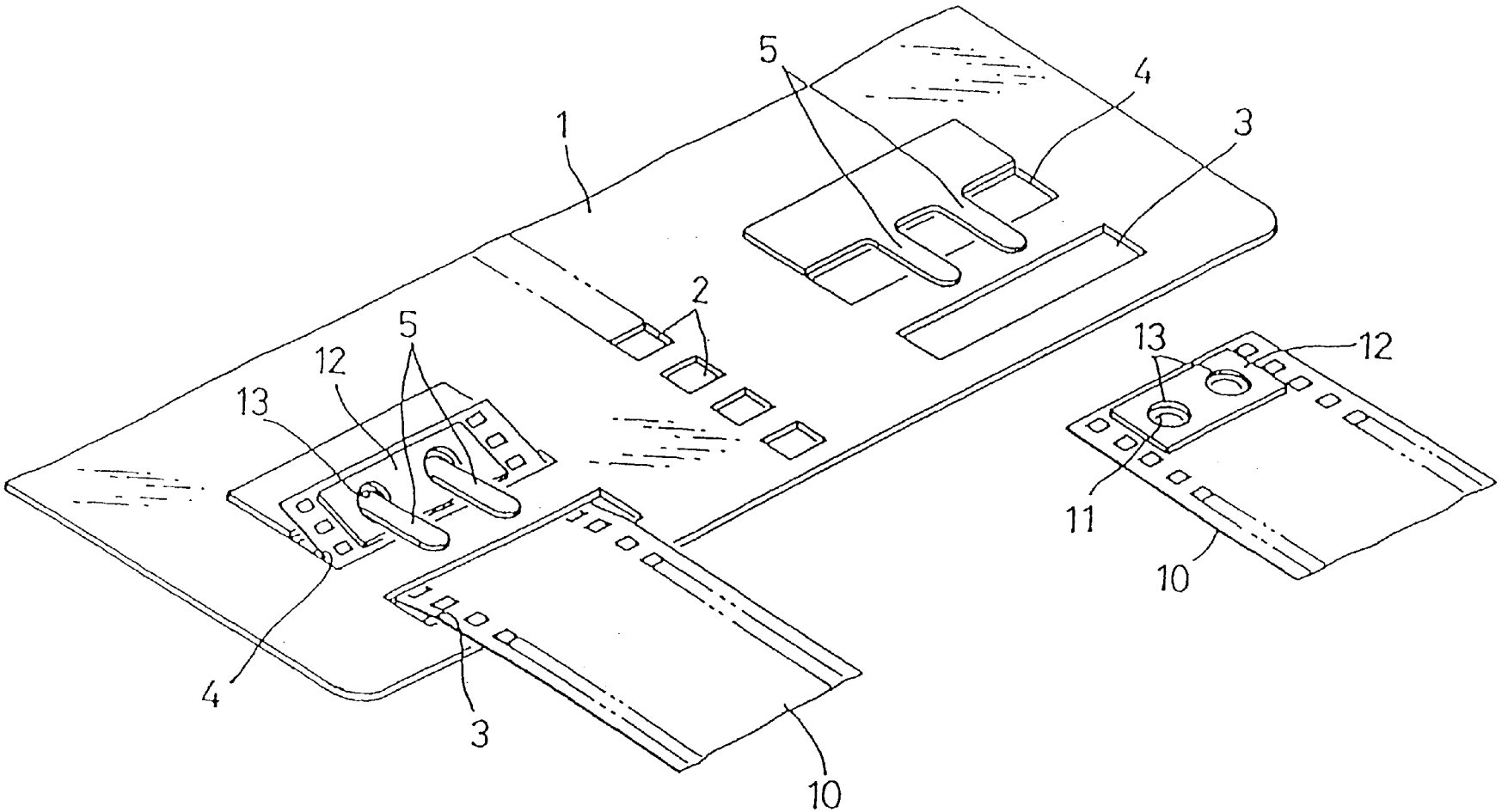
FIG. 1 is an exploded perspective view of a leader and a photographic film according to the invention.

FIG. 1 shows a film pulling leader 1 and an undeveloped photographic film 10 to be pulled by the leader 1.

The leader 1 is flexible because it is made of a synthetic resin sheet. The leader includes feed perforations 2 formed at regular intervals in the middle of the leader 1 along the widthwise direction thereof. First and second insertion holes 3, 4 are formed so as to be spaced apart and along the forward and backward directions of the leader 1 at the left and right sides of the rear end of the leader 1. Above each second insertion hole 4 is a pair of engaging pieces 5 crossing the second insertion hole 4 along the forward and backward directions. The respective engaging pieces 5 are elastic and the front ends thereof are integrally adhered to the leader 1.

The photographic film 10 is formed at its leading end with engaging holes 11 engageable with the engaging pieces 5. The leading end of the photographic film 10 is reinforced by adhering a reinforcement piece 12, which is formed with holes 13 cut in positions corresponding to the engaging holes 11.

The holes 13 may be formed in advance before the reinforcement piece 12 is adhered or may be formed simultaneously with the engaging holes 11 after the reinforcement piece 12 is adhered.

Figure 2:
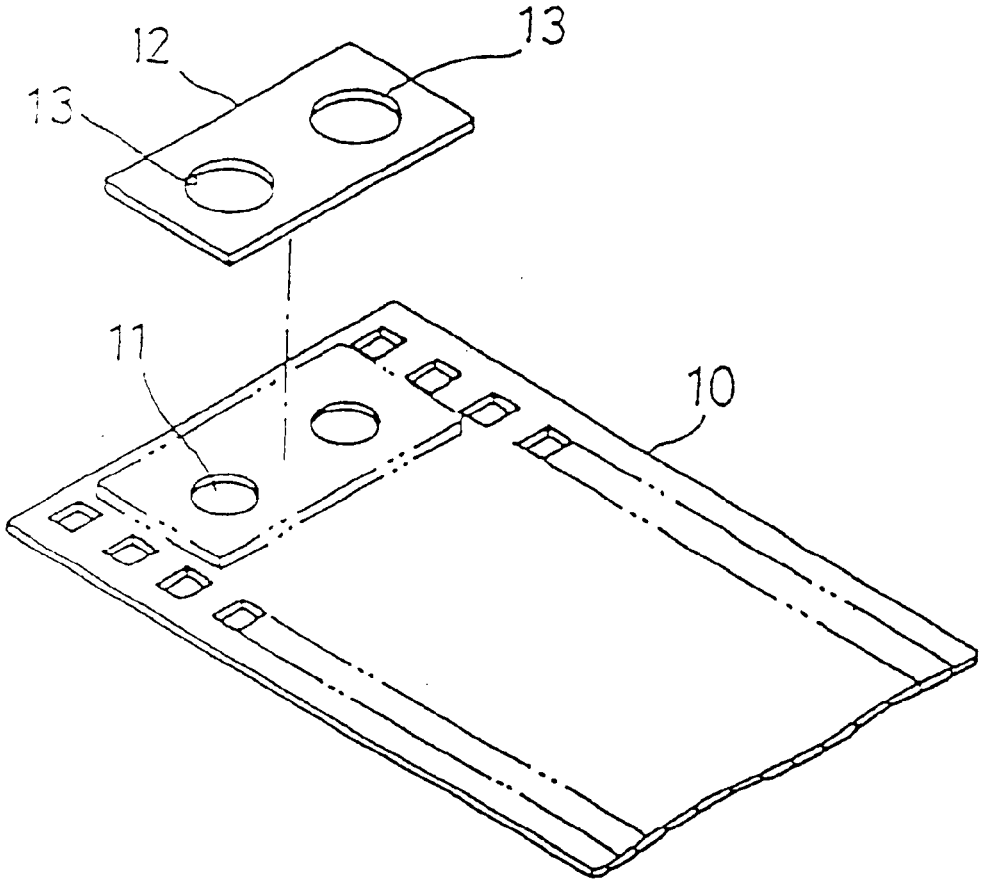
FIG. 2 is an exploded perspective view of the photographic film and a reinforcement piece.
Figure 3:
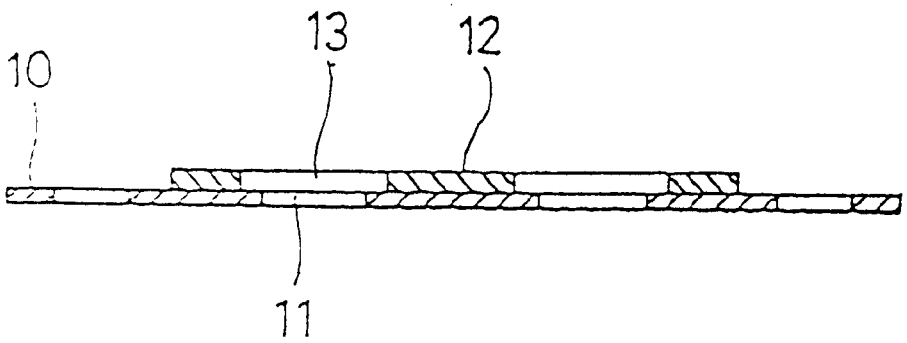
FIG. 3 is a cross sectional view of the photographic film adhered to the reinforcement piece.

In the case that the holes 13 are formed in advance, the inner diameter of the holes 13 is set larger than that of the engaging holes 11 as shown in FIGS. 2 and 3 in order to facilitate the positioning of the holes 13 with respect to the engaging holes 11 and in order to prevent an adhesive used to adhere the reinforcement piece 12 from coming out into the engaging holes 11.

Figure 4:
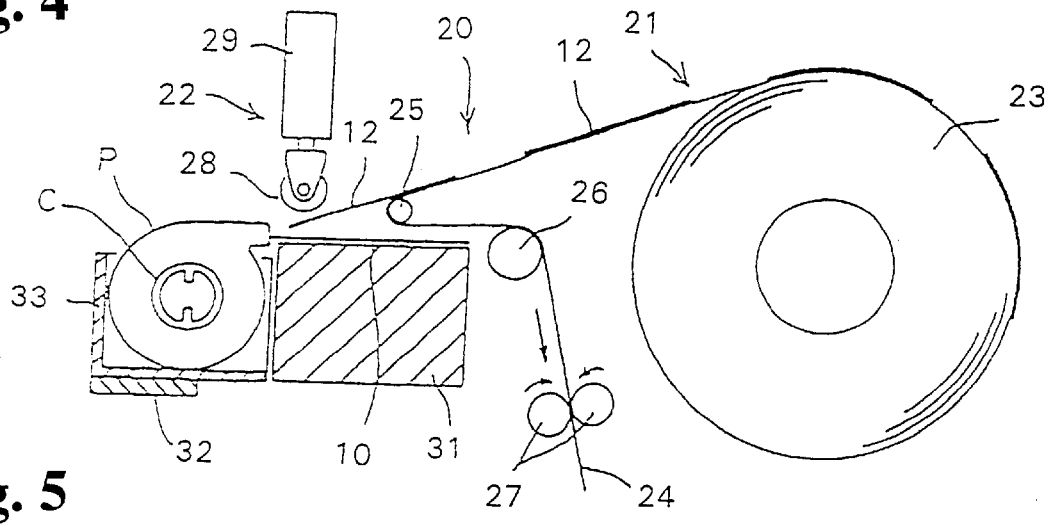
FIG. 4 is a front view of a reinforcement piece adhering apparatus.
Figure 5:
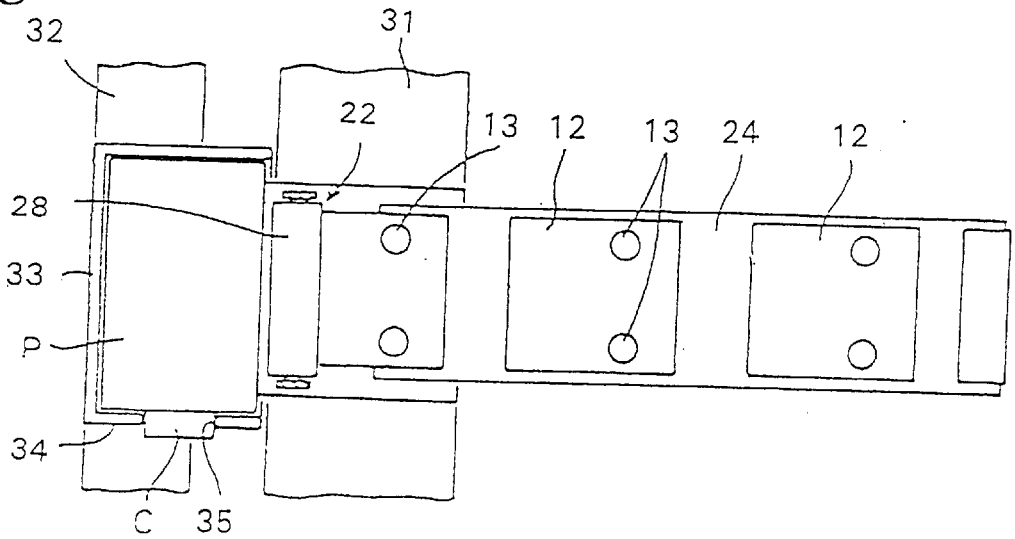
FIG. 5 is a front view showing the operation of the adhering apparatus.
Figure 6:
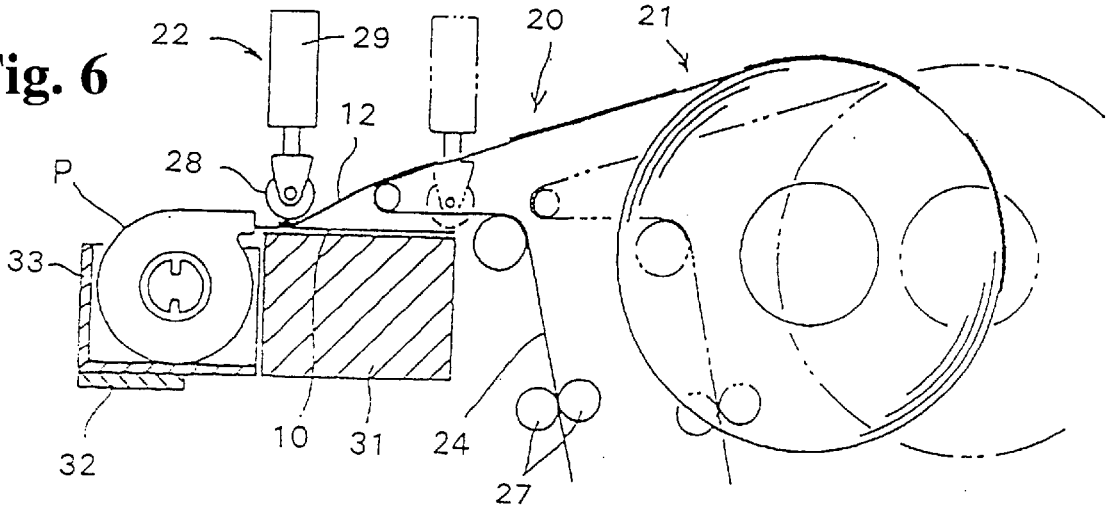
FIG. 6 is a perspective view of another embodiment of the present invention showing the reinforcement piece and the film.

FIGS. 4–6 shows a reinforcement piece adhering apparatus 20 for automatically adhering the reinforcement piece 12 to the photographic film 10.

As shown in FIGS. 4–6, the adhering apparatus 20 is comprised of a reinforcement piece feeding unit 21 and a reinforcement piece pressing device 22 for adhering the reinforcement piece 12 fed from the feeding unit 21 to the upper surface of the photographic film 10. The feeding unit 21 operates as follows. A separator 24 pulled from a rotatably supported reinforcement piece roll 23 to a table 31 is guided by a first guide 25 in the form of a roller, thereby reversing the direction of conveyance. The separator 24 is further guided by a second guide 26 and inserted between a pair of feed rollers 27, and is moved by the rotation of the feed rollers in the directions shown by the arrows. In this way, the reinforcement piece 12 adhered to the separator 24 is peeled back from the separator 24 in the position of the first guide 25.

When one reinforcement piece 12 is peeled from the separator 24, the pair of feed rollers 27 move the separator 24 until the leading end of the next reinforcement piece 12 is peeled to a specified degree. This reinforcement piece then waits in an adhering position.

The pressing device 22 includes a pressing roller 28 and a solenoid 29 for moving the pressing roller 28 with respect to the upper surface of the table 31.

The solenoid 29 of the pressing device 22 lowers the pressing roller 28 after the photographic film 10 is pulled from a cartridge P placed on a cartridge holder 33 on a support table 32 in such a manner that a spool C projects through a notch 35 formed in one side surface 34. By the downward movement of the pressing roller 28, the leading end of the reinforcement piece 12 is adhered to the upper surface of the photographic film 10.

The pressing device 22 and the feeding unit 21 are moved respectively to positions shown in phantom in FIG. 6 when the pressing roller 22 presses the reinforcement piece 12. By this movement, the reinforcement piece 12 is peeled from the separator 24 and is adhered to the leading end of the photographic film 10 by the pressing roller 28.

Here, the pair of holes 13 are cut in the reinforcement piece 12 and they are larger than the engaging holes 11 formed in the photographic film 10 as shown in FIG. 2. This reinforcement piece 12 is adhered to the upper surface of the photographic film 10 such that the holes 13 face the engaging holes 11.

Figure 7:
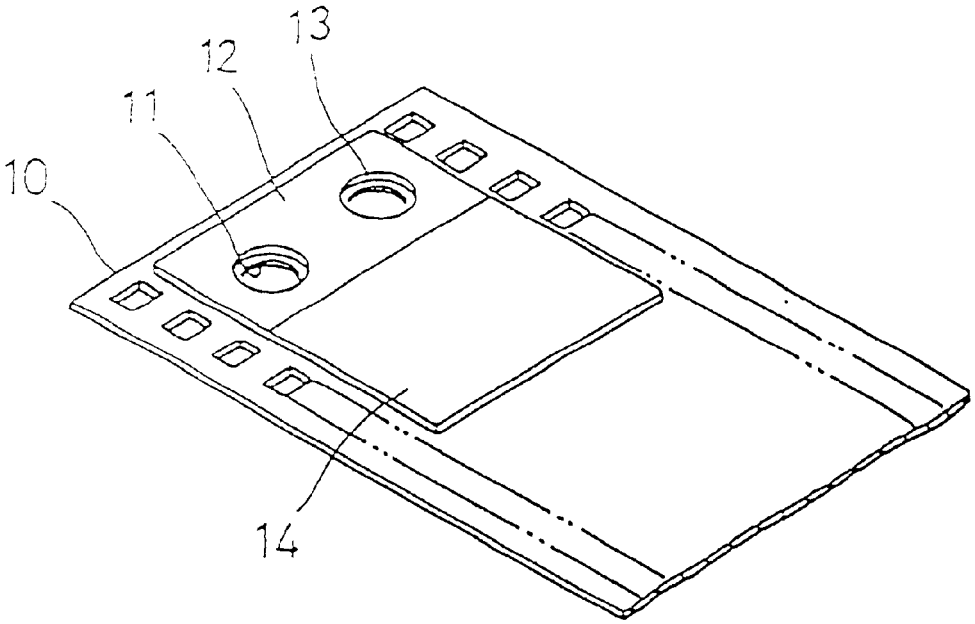
FIG. 7 is a cross sectional view showing a connected state of the leader and the photographic film.

The reinforcement piece 12 may be made of any desired material. If a heat tape which can be adhered by application of heat is used, data necessary for the development can be printed on the reinforcement piece since the base material of the heat tape is made of paper. As shown in FIG. 7, a large amount of data can be written by forming a data writing portion 14 continuous with the reinforcement piece 12.

Figure 8:
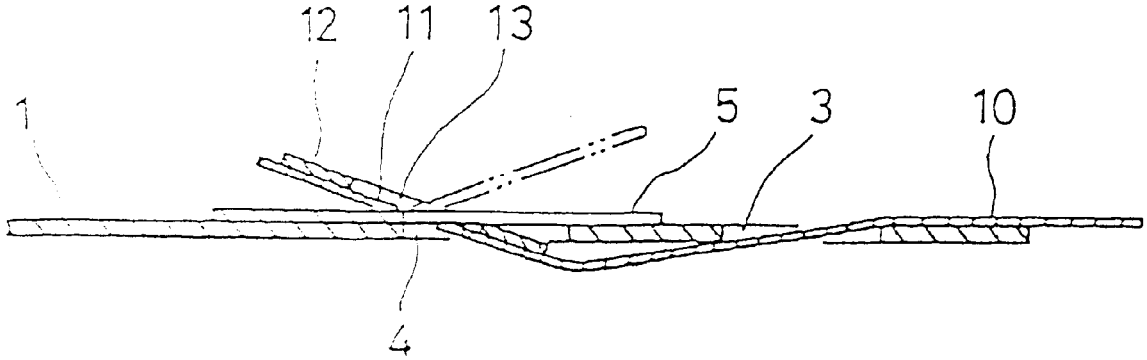
FIG. 8 is a cross sectional view showing the photographic film connected to the leader.

During the development of the photographic film 10 having the above construction, as shown in FIG. 8, the leading end of the photographic film 10 is inserted into the first insertion hole 3 from the front side of the leader 1. The leading end projecting to the rear side of the leader 1 is inserted into the second insertion hole 4. Then the engaging holes 11 are engaged with the engaging pieces 5. Thereafter, the photographic film 10 is conveyed after the leader 1 along the developing device of the automatic film developing apparatus.

Since the photographic film 10 is pulled by the leader 1, various loads act on the engaging portions of the engaging holes 11 with the engaging pieces 5 if the photographic film 10 is caught in the conveyance path.

At this time, since the portion of the photographic film 10 around the engaging holes 11 is reinforced by adhering the reinforcement piece 12, there is no likelihood that the photographic film 10 is torn at the engaging holes 11 even if the photographic film 10 will be a thin and soft film such as 135 film. Therefore, the photographic film 10 can be securely conveyed together with the leader 1 along the developing device.

As described above, according to the invention, the leading end of the photographic film formed with the engaging holes is reinforced by adhering the reinforcement piece thereto. Accordingly, the connecting strength of the photographic film with the leader can be enhanced, making it possible to prevent the photographic film from being torn at the engaging holes while the photographic film is conveyed by being pulled by the leader.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A photographic film comprising: a leading end portion thereof with at least one engaging hole which is engageable with a corresponding engaging piece provided on a leader for pulling the photographic film, wherein said leading end portion of the film is reinforced by adhering a reinforcement member thereto, said reinforcement member being formed with a hole cut in a position facing and corresponding to said at least one engaging hole, said reinforcement member being disposed only on one side of the film.

2. A photographic film according to claim 1, wherein the inner diameter of the hole in said reinforcement member is larger than the inner diameter of said at least one engaging hole.

3. A photographic film according to claim 1, further comprising a data writing portion adjacent to said reinforcement member.

4. A photographic film according to claim 1, wherein said reinforcement member includes a data writing portion thereon.

5. A photographic film as defined in claim 1, wherein said at least one engaging hole comprises a pair of engaging holes and said reinforcement member extends substantially between the pair of engaging holes.

6. A photographic film comprising: a leading end portion thereof with at least one engaging hole which is engageable with a corresponding engaging piece provided on a leader for pulling the photographic film, wherein said leading end portion of the film is reinforced by adhering a reinforcement member thereto, said reinforcement member being formed with a hole cut in a position facing and corresponding to said at least one engaging hole, said reinforcement member being disposed on one side of the film, and wherein an inner diameter of the hole in said reinforcement member is larger than an inner diameter of said at least one engaging hole.

7. A photographic film comprising: a leading end portion thereof with at least one engaging hole which is engageable with a corresponding engaging piece provided on a leader for pulling the photographic film, wherein said leading end portion of the film is reinforced by adhering a reinforcement member thereto, said reinforcement member being formed with a hole cut in a position facing and corresponding to said at least one engaging hole, and wherein an inner diameter of the hole in said reinforcement member is larger than an inner diameter of said at least one engaging hole.

* * * * *